United States Patent [19]

Felder

[11] 4,286,656

[45] Sep. 1, 1981

[54] COMPOSITE CARRIER BAR DEVICE

[76] Inventor: Donald W. Felder, 1153A Drennan Park, Fort Campbell, Ky. 42223

[21] Appl. No.: 11,691

[22] Filed: Feb. 12, 1979

[51] Int. Cl.[3] ..... E21B 17/02

[52] U.S. Cl. ..... 166/75 R; 74/586; 403/31

[58] Field of Search ..... 166/75; 403/31, 37; 74/583, 586, 589, 41, 108; 97/13.1

[56] References Cited

U.S. PATENT DOCUMENTS

| | | | |
|---|---|---|---|
| 2,237,303 | 4/1941 | Calhoun | 74/583 |
| 2,259,019 | 10/1941 | Carr et al. | 74/586 |
| 2,259,020 | 10/1941 | Wineman | 74/589 |
| 3,051,237 | 8/1962 | Liles, Jr. et al. | 74/583 |

*Primary Examiner*—James A. Leppink

*Attorney, Agent, or Firm*—Harrington A. Lackey

[57] ABSTRACT

A composite carrier bar for oil well pumping units that utilize sucker rod to operate bottom hole pumps, including a recessed cavity for receiving a hydraulic ram to operate as a polish rod jack and also including a secondary carrier bar for receiving a secondary polish rod clamp for use in respacing bottom hole pumps and serve as a safety clamp during operation.

4 Claims, 5 Drawing Figures

COMPOSITE CARRIER BAR DEVICE

BACKGROUND OF THE INVENTION

Carrier bars for oil well pumping units are known in the art, having the function of supporting a polish rod clamp, clamped to a polish rod to support the sucker rod string and fluid load as the pumping unit reciprocates the carrier bar to operate a bottom hole pump.

SUMMARY OF THE INVENTION

It is therefore an object of this invention to provide a composite carrier bar device which can internally receive a hollow hydraulic ram, for maximum utilization of space between the pumping unit and well head, to operate as a polish rod jack for respacing bottom hole pumps.

It is another object of this invention to provide a secondary carrier bar to support a secondary polish rod clamp to be used while the primary rod clamp is repositioned and the polish rod jack is repositioned for respacing of more than the stroke of the polish rod jack and also the secondary rod clamp is to serve as a safety clamp during operation.

DESCRIPTION OF THE PREFERRED EMBODIMENT

Figure 1:
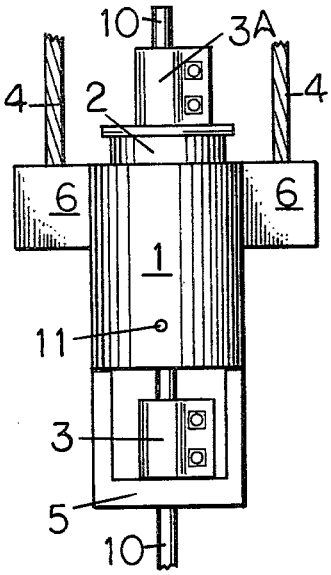
FIG. 1 is a view of the composite carrier bar as it would appear when suspended from an oil well pumping unit.

Referring now to the drawings in more detail, FIG. 1 depicts the composite carrier bar 1 suspended from an oil well pumping unit (not shown) by the carrier bar sling cables 4. The sling cables 4 are attached through receptacles 7 of the support ears 6 projecting laterally from the main body of the carrier bar 1. FIG. 1 shows a hollow hydraulic ram 2 which serves as a polish rod jack, with polish rod clamp 3A clamped to polish rod 10, in place atop the ram 2. Also seen in FIG. 1 is the hydraulic fitting port 11 provided to allow a conventional hydraulic fitting to be threaded into the ram 2, through the wall of the ram cavity 9 after the ram 2 is in place. Also referring to FIG. 1, the secondary polish rod clamp 3 can be seen atop the secondary carrier bar 5.

Figure 2:
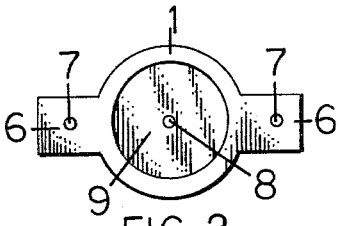
FIG. 2 is a view of the composite carrier bar as it would appear when viewed from above.
Figure 5:
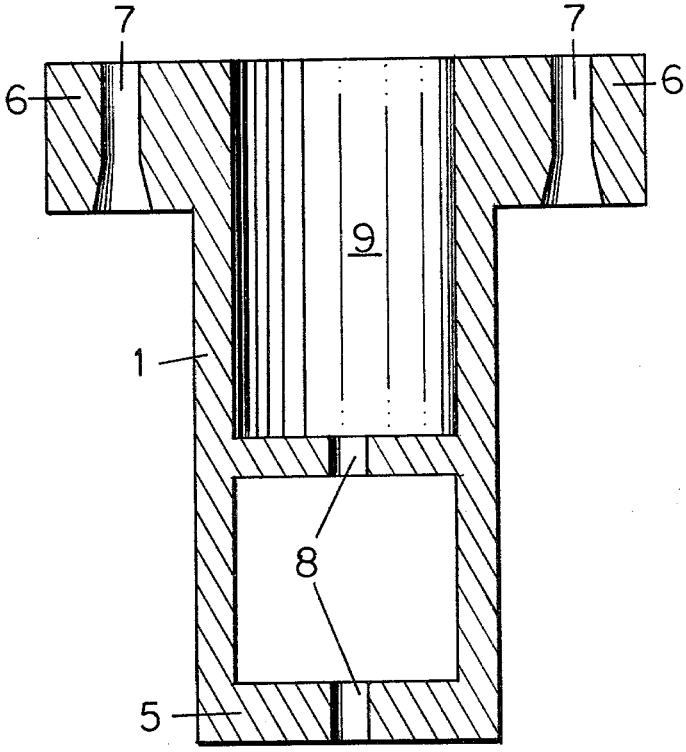
FIG. 5 is an enlarged cutaway view of the composite carrier bar as it would appear when cut from "A" to "B" as depicted in FIG. 4 and rotated 90 degrees.

FIG. 2 indicates the recessed cavity 9 of the carrier bar 1 and the polish rod holes 8 that pass through the carrier bar center as observed from above. The rod holes 8 can be observed in more detail by referring to FIG. 5.

Figure 3:
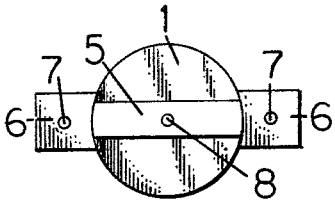
FIG. 3 is a view of the composite carrier bar as it would appear when viewed from the bottom.

FIG. 3 depicts the secondary carrier bar 5 as it would appear when observed from below and also the polish rod hole 8.

Figure 4:
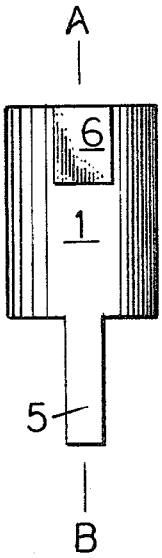
FIG. 4 is a side view of the composite carrier bar.

FIG. 4 shows the composite carrier bar 1 with the support ears 6 and the secondary carrier bar 5 as it would appear when observed from a side.

In use, the composite carrier bar 1 is suspended from an oil well pumping unit by sling cables 4 attached through support ears 6. The polish rod 10 passes up through the holes 8 in the secondary carrier bar 5 and the bottom center of the polish rod jack cavity 9, continues up through the center of the hollow hydraulic ram 2 and protrudes a sufficient length to allow the attachment of a polish rod clamp 3A. A conventional hydraulic fitting (not shown) is passed through the wall of the polish rod jack cavity 9 by way of port 11 and threaded into the conventional hollow hydraulic ram 2, to provide an attachment point for a hydraulic connection.

An advantage of the composite carrier bar 1 is to allow maximum utilization of the space between the pumping unit and the well head in that the top of the piston of the hydraulic ram 2 is even with the top of the composite carrier bar 1 when not extended, whereas when a hydraulic ram is placed atop a conventional carrier bar, the top of the piston of the hydraulic ram is already the length of the collapsed ram above the carrier bar.

Another advantage of the composite carrier bar device is the secondary carrier bar 5. When the bottom hole pump is to be respaced more than the stroke of the hydraulic ram 2, after the hydraulic ram 2 has moved the limit of its travel in the desired direction, rod clamp 3 is tightened in place atop the secondary carrier bar 5. The primary rod clamp 3A can now be loosened and clamp 3 will support the load. The polish rod jack 2 can now be retracted or extended the desired direction and clamp 3A repositioned and tightened into its new position. Then clamp 3 can be loosened and the polish rod jack 2 can be extended or retracted as required. After the completion of the pump respacing operation, clamp 3 can be tightened in place slightly above the secondary carrier bar 5 so that in the event of failure of clamp 3A, the polish rod above clamp 3 or the polish rod jack 2, clamp 3 will drop into contact with the secondary carrier bar 5 and support the load, so that the pumping unit can continue to operate without damaging additional equipment or loss of production.

The presently preferred embodiment of this invention is intended to cover both new fabrications and aftermarket modifications.

Various modifications of the composite carrier bar device will become apparent to those persons ordinarily skilled in the art and the present invention is intended to cover all such obvious modifications falling within the spirit and scope of the invention as defined in the appended claims.

I claim:

1. In an oil well pumping unit utilizing a sucker rod, including a polish rod, for operating a bottom hole pump, a composite carrier bar device comprising:

(a) a main body having top and bottom portions and a central ram cavity therein opening through said top portion for receiving a hydraulic ram in upright position, (b) support means on said main body for supporting said main body in the pumping unit, (c) a secondary carrier bar fixed to and spaced centrally below said main body a predetermined distance, (d) said main body and said secondary carrier bar having vertically aligned holes therethrough for slidably receiving the polish rod of the pumping unit, (e) an upper clamp member above said main body adapted to be releasably clamped to the polish rod in various vertically adjusted fixed positions, (f) said upper clamp member being adapted to rest upon the top of a hydraulic ram received in said ram cavity while said upper clamp member is clamped to said polish rod in fixed position, (g) a lower clamp member having a height less than said predetermined distance and positioned within the space between said secondary carrier bar and said main body, said lower clamp member being adapted to be releasably clamped to the polish rod in various vertically adjusted positions in said space, and (h) said lower clamp member being adapted to rest on said secondary carrier bar while clamped to said polish rod in an operative position.

2. The invention according to claim 1 in which said support means comprise a pair of support ears projecting laterally in opposite directions from said main body, and connection members in said ears for connecting said ears to the respective sling cables of the pumping unit.

3. The invention according to claim 2 in which said support ears extend from said main body adjacent the top portion of said main body.

4. The invention according to claim 1 further comprising a port extending through said main body to permit fluid communication between said ram cavity and the exterior of said main body for receiving a hydraulic fitting for supplying hydraulic fluid to a hydraulic ram when received in said ram cavity.

* * * * *